US007727045B2

(12) United States Patent
Yasui

(10) Patent No.: US 7,727,045 B2
(45) Date of Patent: Jun. 1, 2010

(54) PAPER DOLL

(75) Inventor: Tomohiro Yasui, Kyoto (JP)

(73) Assignee: Butterfly. Stroke. Inc., Tokyo (JP)

( * ) Notice: Subject to any disclaimer, the term of this patent is extended or adjusted under 35 U.S.C. 154(b) by 793 days.

(21) Appl. No.: 10/571,555

(22) PCT Filed: Aug. 31, 2004

(86) PCT No.: PCT/JP2004/012525

§ 371 (c)(1),
(2), (4) Date: Jan. 30, 2007

(87) PCT Pub. No.: WO2005/025709

PCT Pub. Date: Mar. 24, 2005

(65) Prior Publication Data

US 2007/0128974 A1 Jun. 7, 2007

(30) Foreign Application Priority Data

Sep. 12, 2003 (JP) ..... 2003-321710

(51) Int. Cl.

| | |
|---|---|
| ***A63H 3/16*** | (2006.01) |
| ***A63H 3/20*** | (2006.01) |
| ***A63H 3/08*** | (2006.01) |
| ***A63H 33/16*** | (2006.01) |

(52) U.S. Cl. ..... 446/330; 446/97; 446/388; 446/488

(58) Field of Classification Search ..... 446/388, 446/387, 385, 334, 333, 101, 102, 97, 381, 446/383, 390, 359
See application file for complete search history.

(56) References Cited

U.S. PATENT DOCUMENTS 1,422,840 A * 7/1922 De Grasse ..... 446/374
2,149,254 A * 3/1939 Corswirt ..... 446/87

(Continued)

FOREIGN PATENT DOCUMENTS

JP 52-71499 5/1977

(Continued)

*Primary Examiner*—Gene Kim
*Assistant Examiner*—Alyssa M Hylinski
(74) *Attorney, Agent, or Firm*—Oblon, Spivak, McClelland, Maier & Neustadt, L.L.P.

(57) ABSTRACT

A paper doll in which a trunk portion is hollow and disposed with its axial line directed in a longitudinal direction. Right and left shoulder joint members each formed in an approximately U-shape are rotatably coupled with the trunk portion by a first metal coupling passing through the trunk portion and the intermediate wall portions of the shoulder joint members. The base end portion of each of hollow upper arm members is held between a pair of side wall portions of the shoulder joint member and the upper arm members are rotatably coupled with the shoulder joint members by a second metal coupling passing through the side wall portions and the upper arm members, and femoral members each formed to be hollow are rotatably abutted against the trunk portion through the portions where the femoral members are abutted against sides of the trunk portion by a third metal coupling.

12 Claims, 9 Drawing Sheets

U.S. PATENT DOCUMENTS

| | | | | | |
|---|---|---|---|---|---|
| D137,551 | S | * | 3/1944 | Baker | D21/594 |
| 2,927,400 | A | * | 3/1960 | Bailey | 446/376 |
| 3,010,253 | A | * | 11/1961 | Ostrander | 446/380 |
| 3,634,966 | A | * | 1/1972 | Ostrander | 446/380 |
| 3,942,284 | A | * | 3/1976 | Kublan | 446/380 |
| 4,279,099 | A | * | 7/1981 | Dyer et al. | 446/330 |
| 4,798,317 | A | * | 1/1989 | Lonczak | 223/66 |
| 6,120,344 | A | * | 9/2000 | Brown | 446/388 |
| 6,136,400 | A | * | 10/2000 | Katayose et al. | 428/42.1 |
| 6,422,916 | B1 | * | 7/2002 | Enku | 446/330 |
| 2002/0089297 | A1 | * | 7/2002 | Filo | 318/568.12 |

FOREIGN PATENT DOCUMENTS

| | | |
|---|---|---|
| JP | 3-35062 | 4/1991 |
| JP | 6-7796 | 2/1994 |
| JP | 3/070126 | 7/2000 |
| JP | 2001-128835 | 5/2001 |
| JP | 2002-227829 | 8/2002 |

* cited by examiner

PAPER DOLL

TECHNICAL FIELD

The present invention relates to a paper doll made by coupling a plurality of parts formed by folding a thick paper sheet.

BACKGROUND ART

There are ordinarily found dolls that are made by movably coupling various parts such as a head, a trunk, both right and left arms, both legs, and the like with each other. Among these dolls, there are also widely known paper dolls which can be three-dimensionally made by one's own work by cutting out a thick paper sheet, and folding and bonding the cut-out paper sheets.

In many of these paper dolls, the arms and legs of the dolls can be bent in the joint portions of the shoulders, elbows, crotches, knees, and the like thereof to realize motion near to human motion. In this type of the dolls, however, since the motion of the joint portions is ordinarily very mechanical and stiff, it is difficult for the dolls to express the flexible motion of the joints similar to the human motion. Accordingly, even if it is admitted that the motion of the dolls cannot help being restricted because they are made of the paper sheet, the motion of them is greatly different from the human motion in many cases.

In contrast, in paper doll kits having a plurality of movable joint portions as described above, there is a tendency that the arrangement of the joint portions are made complex, which often makes it difficult to form a doll in its entirety.

Patent document 1: Japanese Unexamined Utility Model Application Publication No. 59-73993

Patent document 2: Japanese Unexamined Utility Model Application Publication No. 59-76294

Patent document 3: Japanese Utility Model Gazette No. 3068314

DISCLOSURE OF THE INVENTION

A technical subject of the present invention, which was made to overcome the above problems, is to provide a paper doll that can realize motion near to actual human motion by a relatively simple arrangement.

To solve the above problems, a paper doll of the present invention is characterized by being composed of a plurality of flexible parts formed of a folded paper sheet and coupled with each other, wherein: the plurality of parts includes a trunk portion, a head portion, right and left arms, right and left legs, and right and left shoulder joint members for attaching the arms to the trunk portion, the trunk portion is formed to be hollow and disposed with its axial line directed in a longitudinal direction, each of the right and left shoulder joint members is formed in an approximately U-shape and includes an intermediate wall portion abutted against a side of the trunk portion and a pair of side wall portions opening outward, and the shoulder joint members are rotatably coupled with the trunk portion through the intermediate wall portions, each of the arms includes an upper arm member, a forearm member and a wrist member movably coupled with each other, at least the upper arm member is formed to be hollow, the base end portion of the upper arm member is held between the pair of side wall portions of the shoulder joint member, and the side wall portions are rotatably coupled with the upper arm member, and each of the legs includes a femoral member, a crus member, and a foot member movably coupled each other, at least the femoral member is formed to be hollow, and the femoral member is abutted against a side of the trunk portion and rotatably coupled with the trunk portion.

According to the paper doll arranged as described above, when the arms and the legs are moved with respect to the trunk portion, the shoulder joint members, which are formed in the approximately U-shape, are deformed by being flexed, and the trunk portion, the upper arm members, and the femoral members, which are formed to be hollow, are deformed by being flexed and crashed, thereby the respective joint portions exhibit flexible motion. Accordingly, mechanical and stiff motion is reduced different from the conventional dolls, which makes it possible to cause the paper doll to exhibit motion nearer to human motion by a relatively simple arrangement.

According to a specific arrangement of the present invention, the trunk portion is formed of a hollow chest member having a largest section size, a hollow abdomen member having an intermediate section size and a hollow waist member having a smallest section size, these members being coupled with each other, the chest member has recesses formed on the right and left sides thereof and extending in a axial direction, the shoulder joint members are coupled with the chest member at the positions of the recesses, and the legs are coupled with the waist member.

In the paper doll described above, a plurality of flexible parts formed of a folded sheet are movably coupled by metal couplings, wherein the right and left shoulder joint members are rotatably coupled with the trunk portion by a first metal coupling passing through the trunk portion and the intermediate wall portions of the shoulder joint members, the base end portions of the upper arm members are rotatably coupled with shoulder joint members by a second metal coupling passing through the pair of side wall portions of the shoulder joint members and the upper arm members, and the femoral members are coupled with the trunk portion by a third metal coupling passing through the trunk portion. With this arrangement, the joint portions of the doll can be realized by the relatively simple arrangement in which the metal couplings pass through the coupling portions of the parts to be coupled with each other, thereby the doll can be made easily, and moreover the parts can be replaced by a simple replacement job.

According to another specific arrangement of the present invention, the arms further include shoulder members for covering the coupling portions of the shoulder joint members and the upper arm members, the shoulder members are bent in a U-shape and rotatably attached to the shoulder joint members by the second metal coupling.

Further, according to still another specific arrangement of the present invention, each of the legs further includes an approximately U-shaped knee member for covering the coupling portion of the femoral member and the crus member and an approximately U-shaped ankle cover member for covering the coupling portion of the femoral member and the foot member, the knee member is rotatably coupled with the coupling portion of the femoral member and the crus member by a fourth metal coupling for coupling both the members, and the ankle cover member is rotatably coupled with the coupling portion of both the members by a fifth metal coupling for coupling the crus member with the foot member.

Further, in the present invention, each of the metal couplings is formed of a metal wire having a softened surface, has extraction preventing bent portions, which are formed by bending the ends of the wire in a direction perpendicular to the axial direction, at both the ends thereof and has a winding portion, which is formed by winding the end of the metal coupling on the bent portion, and an ear portion for rotating the bent portion at least one end thereof, and the length of the metal coupling can be adjusted by increasing the number of windings of the winding portion. In this case, it is preferable that the surface of each metal coupling be softened by vinyl coating.

Figure 1:
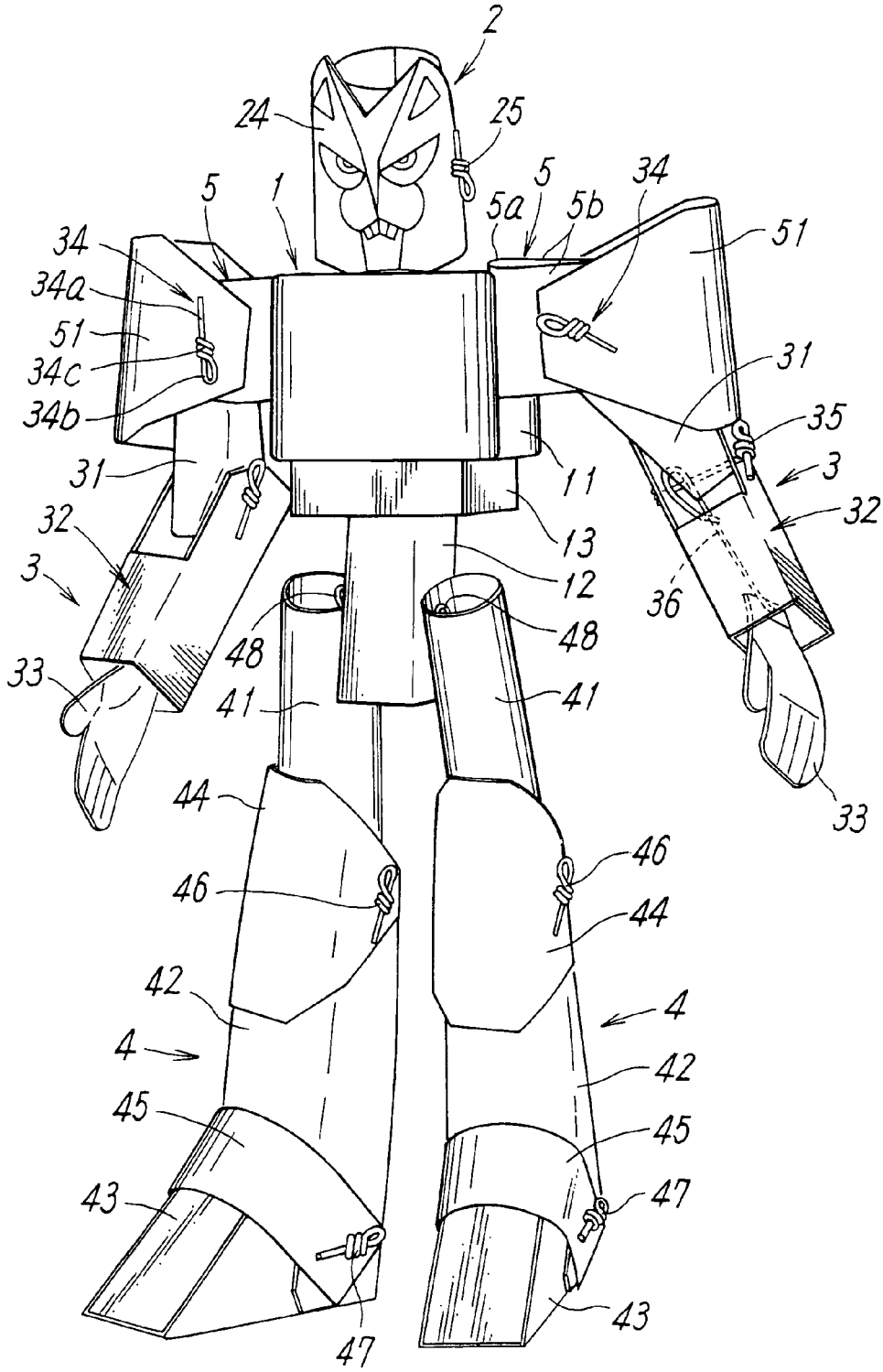
FIG. 1 is a perspective view showing an example of a paper doll according to the present invention.

| Reference Numerals | |
|---|---|
| 1 | trunk portion |
| 2 | head portion |
| 3 | arm |
| 4 | leg |
| 5 | shoulder joint member |
| 5a | intermediate wall portion |
| 5b | side wall portion |
| 11 | chest member |
| 11a | curved recess |
| 12 | waist member |
| 13 | abdomen member |
| 21 | neck member |
| 22 | head lower-half member |
| 23 | head upper-half member |
| 24 | face member |
| 25 | head portion metal coupling |
| 31 | arm member |
| 32 | forearm member |
| 32a | hollow portion |
| 32b | plate-shaped wrist member |
| 32c | elbow plate |
| 33 | wrist member |

-continued

| Reference Numerals | |
|---|---|
| 34 | second metal coupling |
| 34a | bent portion |
| 34b | winding portion |
| 34c | ear portion |
| 35 | elbow metal coupling |
| 36 | wrist metal coupling |
| 41 | femoral member |
| 42 | crus member |
| 42a | knee coupling plate |
| 42b | knee plate |
| 42c | ankle coupling plate |
| 42d | ankle plate |
| 43 | foot member |
| 44 | knee member |
| 45 | ankle cover member |
| 46 | fourth metal coupling |
| 47 | fifth metal coupling |
| 48 | third metal coupling |
| 51 | shoulder member |
| 52 | first metal coupling |

BEST MODE FOR CARRYING OUT THE INVENTION

Figure 2:
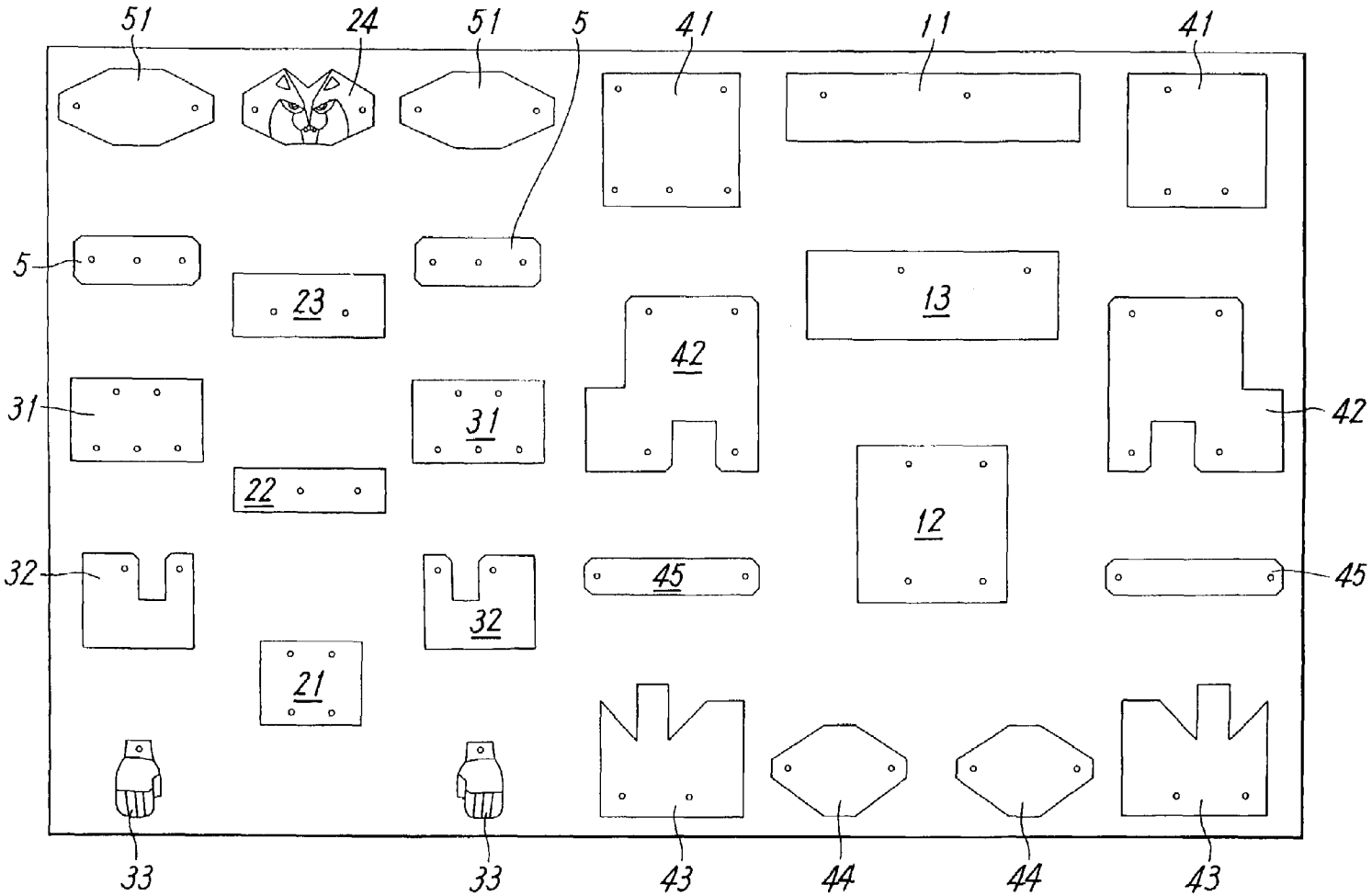
FIG. 2 is a plan view of a state of the paper doll according to the present invention before it is assembled.

FIG. 1 shows an embodiment of the present invention. A paper doll of the embodiment is made by forming a plurality of flexible parts by clipping out the respective parts of the doll from a thick paper sheet as shown in FIG. 2 to predetermined shapes according to the expansion plans thereof printed on the sheet and folding over the respective parts to predetermined shapes, and movably coupling the parts with each other by metal couplings as coupling fittings. The doll has a trunk portion 1, a head portion 2, right and left arms, 3, 3, right and left legs 4, 4, arms 3, 3, and right and left shoulder joint members 5, 5 for attaching the arms, 3, 3 to the trunk portion 1.

Figure 3:
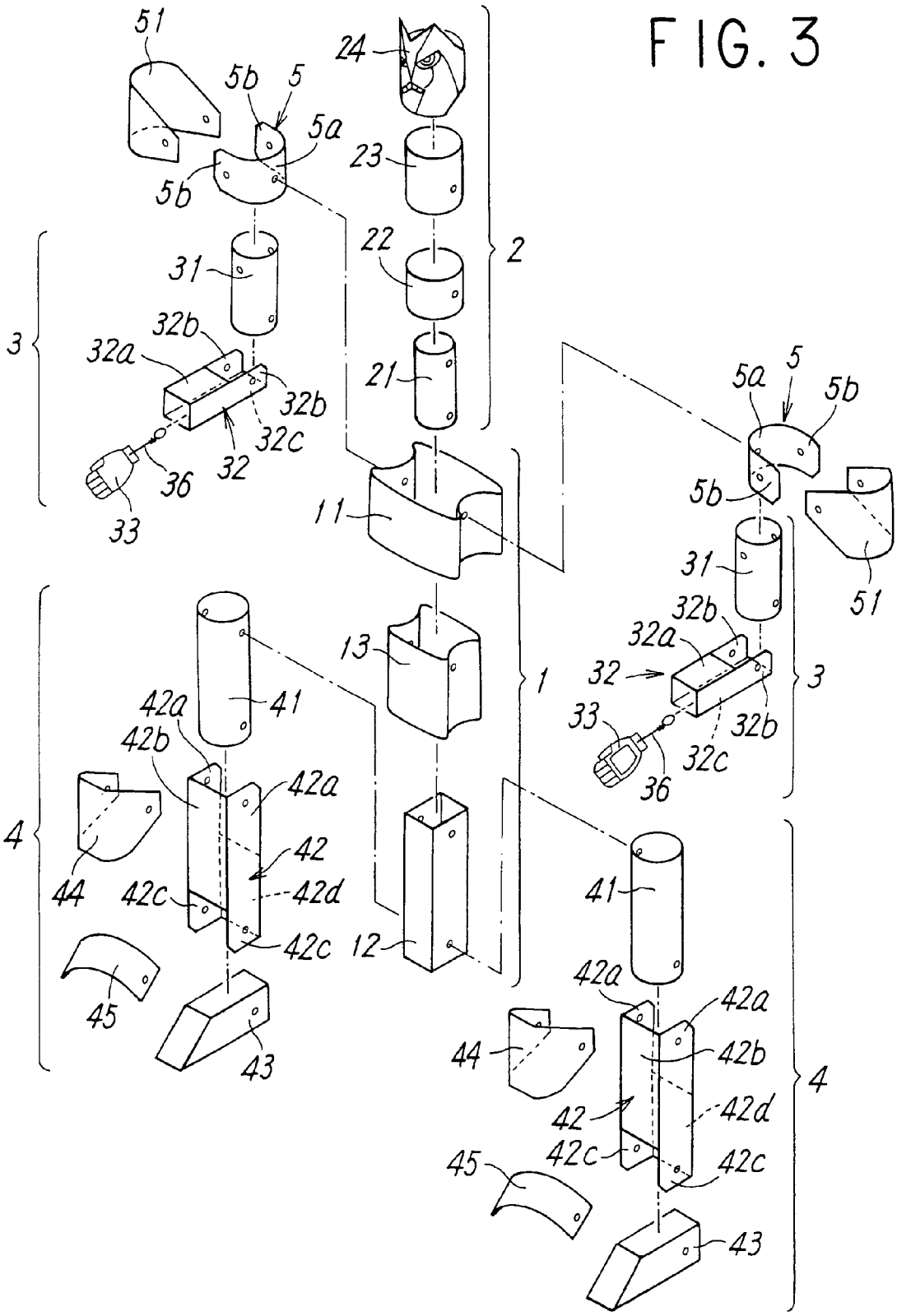
FIG. 3 is an exploded perspective view of the paper doll according to the present invention, wherein metal couplings other than a metal coupling for wrists are omitted.
Figure 4:
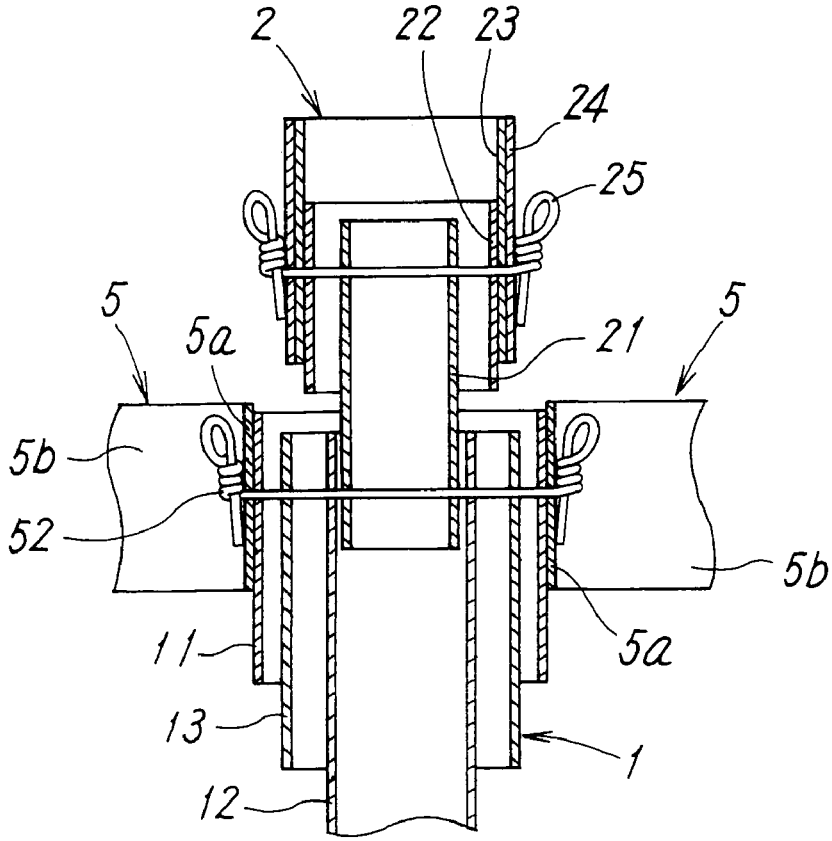
FIG. 4 is a main-portion enlarged sectional view showing the upper half portion of the paper doll according to the present invention.

The trunk portion 1 is formed to be hollow in its entirety and disposed with its axial line facing a longitudinal direction. As shown in FIGS. 3 and 4, the trunk portion 1 has an upper portion formed to be hollow and having a largest sectional size, a lower portion formed to be hollow and having a smallest sectional size, and an intermediate portion formed to be hollow and having an intermediate sectional size, the upper portion acting as a chest member 11 with which the arms, 3, 3 are coupled, the lower portion acting as a waist member 12 with which the legs 4, 4 are coupled, and the intermediate portion acting as the abdomen member 13. The paper doll is arranged by coupling the chest member 11, the abdomen member 13, and the waist member 12 with each other.

Specifically, the chest member 11, the abdomen member 13, and the waist member 12 are formed to be hollow, and each of the longitudinal cross sections thereof perpendicular to an axial line is formed in an approximately rectangular shape. The aspect sizes of them are set smaller in the sequence of the chest member 11, the abdomen member 13, and the waist member 12, and the lengths thereof in an axial direction are set larger in this sequence. The upper portion of the waist member 12 is accommodated in the abdomen member 13 at predetermined intervals, the upper portion of the abdomen member 13 is accommodated in the chest member 11 at predetermined intervals. The respective members 11, 12, and 13 are coupled with each other on the upper sides thereof through a first metal coupling 52 passing the sides thereof in a horizontal direction. At the time, the abdomen member 13 and the waist member 12 are positioned in the chest member 11 by first metal coupling 52 so that the upper ends thereof do not project from the upper side opening of the chest member 11. That is, the trunk portion 1 is formed in such a state that the abdomen member 13 and the waist member 12 are sequentially accommodated in the chest member 11 approximately coaxially at the predetermined intervals from the upper sides thereof as well as the lower side of the abdomen member 13 project from the lower end opening of the chest member 11 as well as the lower side of the waist member 12 projects from the lower opening of the abdomen member 13. The waist member 12 and the abdomen member 13 can be rotated in the chest member 11 using the first metal coupling 52 as a rotation axis.

The head portion 2 is formed to be hollow in its entirety and disposed with its axial line directed in a longitudinal direction. As shown in FIGS. 3 and 4, the head portion 2 has a hollow neck member 21 coupled with the trunk portion 1, a hollow head lower-half member 22 and a hollow head upper-half member 23 each rotatably coupled with the upper portion of the neck member 21, and a curved-plate-shaped face member 24 having a doll face picture drawn thereon, attached to the outer surface of the head upper-half member 23, and forming the front of the head portion 2. The neck member 21 and the respective head members 22, 23 are formed such that the sizes of the cross sections thereof are set smaller in the sequence of the head upper-half member 23, and the neck member 21. Further, the neck member 21 is formed smaller than the size of the cross section of the waist member 12 of the trunk portion 1 and coupled with the trunk portion 1 in a state that the lower side thereof is accommodated in the waist member 12.

Specifically, the neck member 21 and the respective members 22, 23 of the head portion are formed in an approximately cylindrical shape, and the diameters thereof are set smaller in the sequence of the head upper-half member 23, the head lower-half member 22, and the neck member 21. The upper portion of the neck member 21 is accommodated in the head lower-half member 22 at predetermined intervals, and the upper portion of the head lower-half member 22 is accommodated in the head upper-half member 23 in engagement therewith. The curved face member 24 is mounted on the head upper-half member 23 from the front to both right and left sides thereof. These respective members 21, 22, 23, and 24 that constitute the head portion 2 are coupled with each other by a head portion metal coupling 25 passing through both the ends of the neck member 21, the respective head members 22, 23, and the face member 24 in approximately parallel with the first metal coupling 52 of the head portion 2. At the time, the lower portion of the neck member 21 projects from the lower end opening of the head lower-half member 22, is accommodated in the waist member 12 of the trunk portion 1 at predetermined intervals and is coupled with the trunk portion 1 by the first metal coupling 52 passing therethrough. With this arrangement, the neck member 21 can be rotated with respect to the trunk portion 1 using the first metal coupling 52 as the rotation axis, and the head lower-half member 22, the head upper-half member 23, and the face member 24 can be rotated with respect to the neck member 21 using the head portion metal coupling 25 as the rotation axis.

Figure 5:
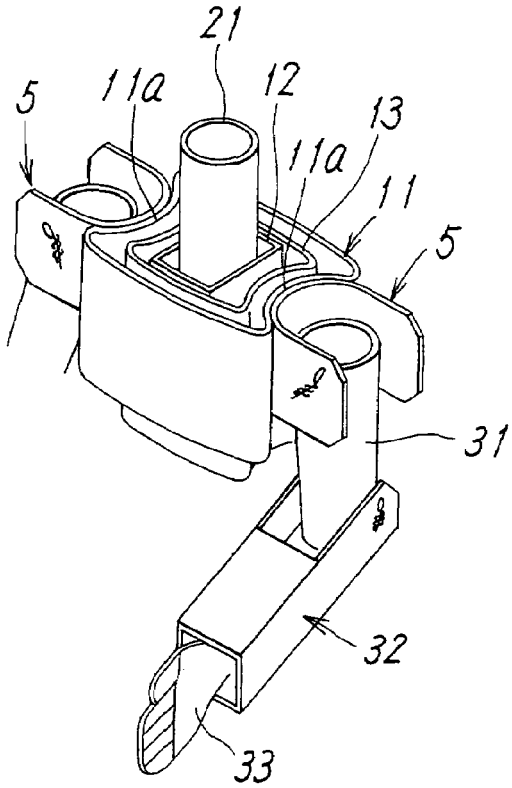
FIG. 5 is a perspective view of the upper half portion, wherein a part of a head portion, a part of a right arm, and shoulder members are omitted.

As shown in FIGS. 3 and 5, each of the shoulder joint members 5, 5 is formed of an approximately-U-shaped plate in its entirety and has an intermediate wall portion 5*a* abutted against a side wall of the chest member 11 of the trunk portion 1 and a pair of side wall portions 5*b*, 5*b* continuous to both the sides of the intermediate wall portion 5*a*, opening outward, that is, in a horizontal direction, and coupled with the arm 3. Further, as shown in FIGS. 1 and 3, a shoulder member 51 formed of an approximately-U-shaped plate is disposed to each shoulder joint member 5 so that its open side confronts the open side of the shoulder joint member 5 and attached thereto so as to cover and conceal the coupling portion thereof with the side wall portions 5*b*, 5*b* and the arm 3. The inner surfaces of the pair of side walls of the shoulder member 51 on the open side thereof are abutted against the outer surfaces of the pair of side wall portions 5*b*, 5*b* of the shoulder joint member 5, and the shoulder member 51 is rotatably attached to the shoulder joint member 5 by a second metal coupling 34 passing through the abutting portion.

The pair of shoulder joint members 5, 5 are rotatably coupled with both right and left sides of the trunk portion 1 by the first metal coupling 52 passing through the trunk portion 1, the neck member 21, and the apexes of the intermediate wall portions 5*a* of the shoulder joint members 5 so that they can be rotated around the first metal coupling 52.

Figure 6:
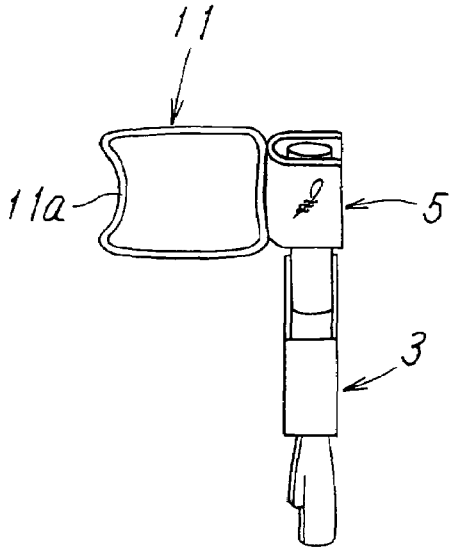
FIG. 6 is a plan view showing a state in which a shoulder joint member is rotated, wherein parts other than a chest member, a shoulder joint member, and a left arm are omitted.
Figure 7:
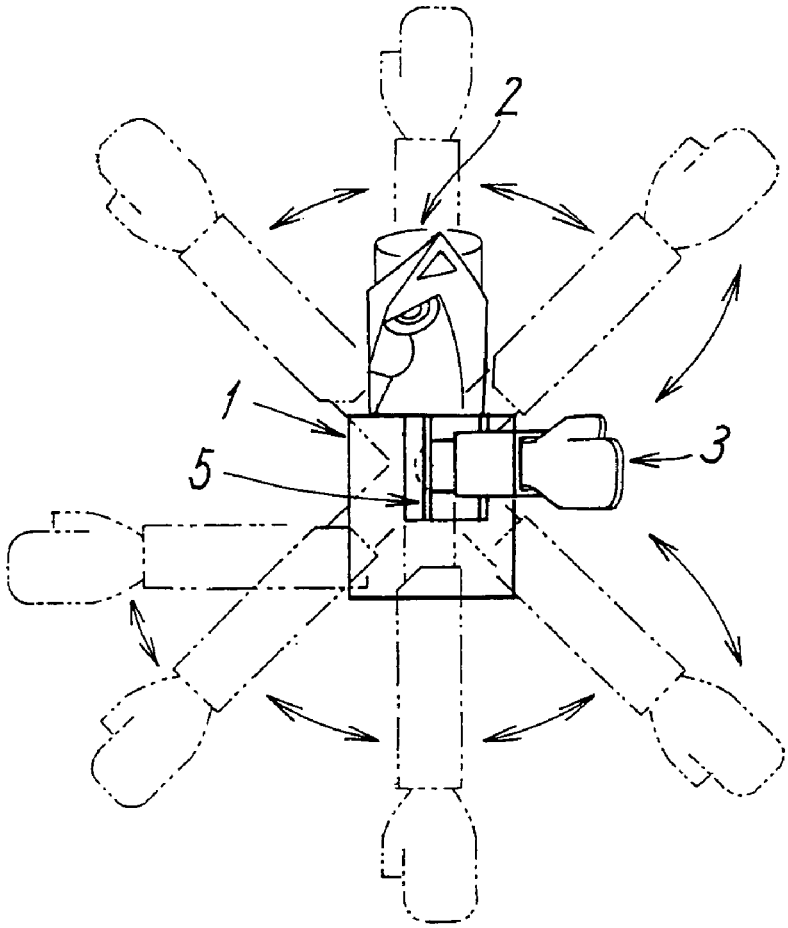
FIG. 7 is a side elevational view schematically showing a range in which an arm can be moved.

As shown in FIGS. 5 and 6, curved recesses 11*a*, 11*a*, which extend in the axial direction, are formed to the right and left sides of the chest member 11 of the trunk portion 1, respectively. The pair of shoulder joint members 5, 5 are coupled with the chest member 11 on the bottom portions of the curved recesses 11*a*, 11*a* by the first metal coupling 52 passing through the bottom portions. Each curved recesses 11*a* is curved with approximately the same curvature as that of the intermediate wall portion 5*a* of the shoulder joint member 5. In an ordinary state, as shown in FIG. 5, the shoulder joint member 5 is held by the curved recess 11*a* in a state that the apex of the intermediate wall portion 5*a* of the shoulder joint member 5 is disposed along the bottom portion of the curved recess 11*a*. In contrast, when the shoulder joint members 5, 5 are rotated together with the arms, 3, 3 using the first metal coupling 52 as an axis of rotation, the intermediate wall portions 5*a* run on the rising portions of the curved recesses 11*a* formed to both the sides (front and rear sides) thereof and act as resistance, thereby the rotating angle of the shoulder joint member 5 to the chest member 11 is restricted as shown in FIG. 6. As described above, subject image cervical esophagus the restriction, which is approximately near to that applied to the rotation of human shoulders, is applied to the rotation of the shoulder joint members 5 to the chest member 11, the motion of the shoulders, which is nearer to that of the human shoulders, can be realized as compared with conventional paper dolls (refer to FIG. 7).

Note that although the width and the curvature of the recesses 11*a* are set such that the shoulder joint members 5 are rotated only about 45° forward and rearward of the chest member 11, respectively, they can be arbitrarily set in consideration of the rotation angle required by the shoulder joint members 5, and the curvature of the intermediate wall portions 5*a* of the shoulder joint members 5, and the like.

As shown in FIGS. 1 and 3, each of the arms, 3, 3 has a hollow upper arm member 31, a hollow forearm member 32, and a plate-shaped wrist member 33. The upper arm member 31 has a base end portion rotatably coupled with the shoulder joint member 5, the forearm member 32 has a base end portion rotatably coupled with the extreme end portion of the upper arm member 31, and the wrist member 33 is disposed to the extreme end of the forearm member 32.

Specifically, the upper arm member 31 is formed in an approximately cylindrical shape. Further, the forearm member 32 is formed to be hollow and having an approximately rectangular cross section in its entirety and has a hollow portion 32*a* formed to the extreme end side thereof, a pair of elbow coupling plates 32*b*, 32*b*, and an elbow plate 32*c* integrally therewith. The pair of elbow coupling plates 32*b*, 32*b* are formed continuously to both the confronting side plates of the hollow portion 32*a* on the base end side thereof and used to be coupled with the upper arm member 31. The elbow plate 32*c* is formed continuously to the back surface plate of the hollow portion 32*a* on the base end side thereof likewise and interposed between the pair of the elbow coupling plates 32*b*, 32*b* to restrict that the forearm member 32 is rotated backward of the upper arm member 31. Note that the surface of the forearm member 32 facing the elbow plate 32*c* is opened, and the cross section of the forearm member 32 on the base end side thereof is formed in an approximately U-shape opening to a front. The upper arm member 31 is accommodated in the front side opening of the forearm member 32 when the forearm member 32 is rotated forward of the upper arm member 31.

The base end portion of the upper arm member 31 is held between the pair of side wall portions 5*b*, 5*b* of the shoulder joint member 5 and rotatably coupled with the shoulder joint member 5 by the second metal coupling 34 passing through the side wall portions 5*b*, 5*b*, the upper arm member 31, and the pair of side walls of the shoulder member 51. As the upper arm member 31 is rotated with respect to the shoulder joint member 5, the shoulder member 51 is also rotated with respect to the shoulder joint member 5 in the same direction as that of the upper arm member 31, thereby the coupling portion of the shoulder joint member 5 and the upper arm member 31 coupled by the second metal coupling 34 is always covered and concealed by the shoulder member 51. Further, the shoulder member 51 also has a function for restricting the upward rotating angle of the upper arm member 31 with respect to the shoulder joint member 5.

As shown in FIG. 1, the forearm member 32 holds the extreme end of the upper arm member 31 between the pair of elbow coupling plates 32*b*, 32*b* formed to the base end portion thereof, and a elbow metal coupling 35 is caused to pass through the upper arm member 31 and the elbow coupling plates 32*b*, 32*b*, thereby the forearm member 32 is rotatably coupled with the upper arm member 31.

Further, as shown in FIG. 1, the wrist member 33 is attached to an end of a wrist metal coupling 36 and disposed at the extreme end of the forearm member 32 by causing the intermediate portion of the wrist metal coupling 36 to pass through the hollow portion 32*a* of the forearm member 32 as well as rotatably winding the other end of the wrist metal coupling 36 around the elbow metal coupling 35.

Figure 8:
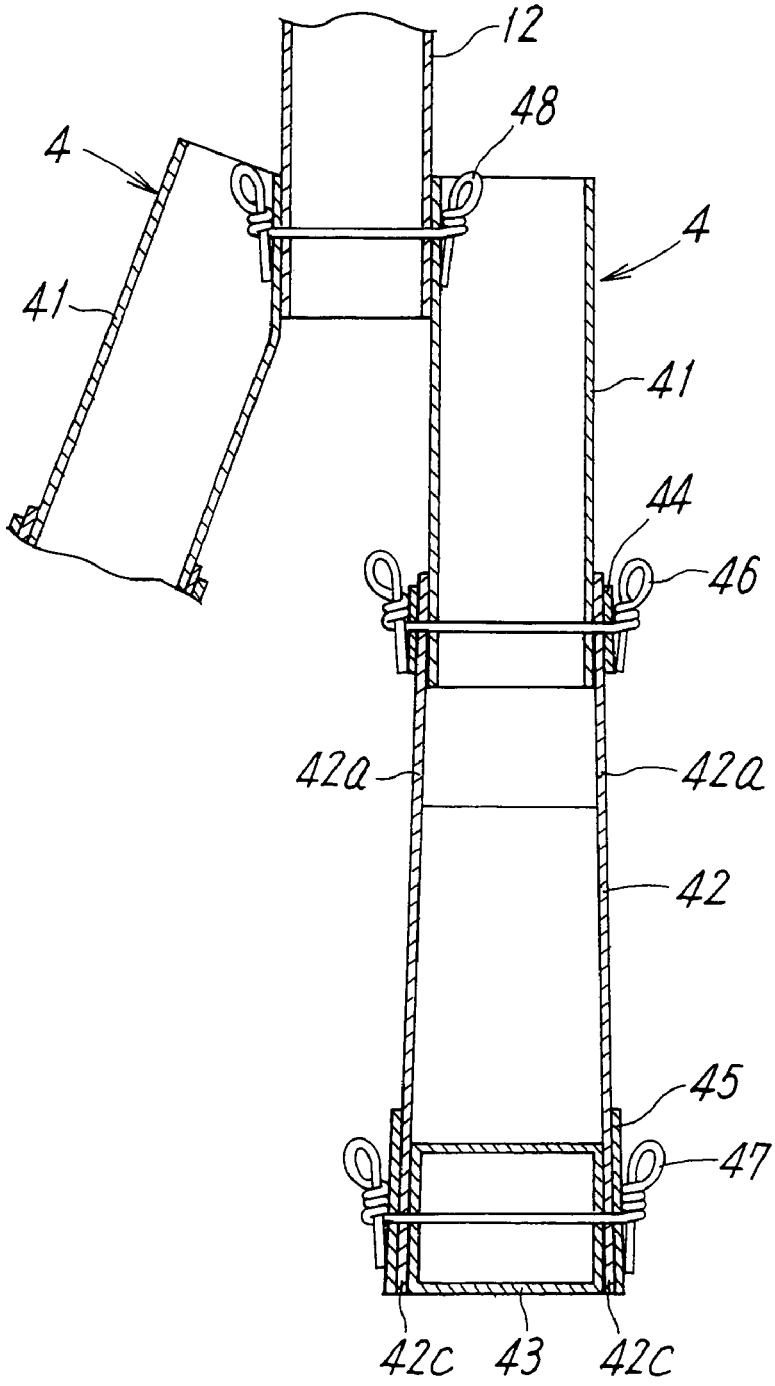
FIG. 8 is a main-portion enlarged sectional view of the lower half portion of a prototype paper doll according to the present invention.

As shown in FIGS. 1, 3, and 8, each of the pair of legs 4, 4 has a hollow femoral member 41 rotatably coupled with the waist member 12 of the trunk portion 1, a hollow crus member 42 rotatably coupled with the femoral member 41, a foot member 43 rotatably coupled with the crus member 42, a curved-plate-shaped knee member 44 covering the coupling portion of the femoral member 41 and the crus member 42 and rotatably attached to the coupling portion, and a curved-plate-shaped ankle cover member 45 covering the coupling portion of the crus member 42 and the foot member 43 and rotatably attached to the coupling portion.

Specifically, the femoral member 41 is formed in an approximately cylindrical shape. As shown in FIG. 3, the crus member 42 is formed to be hollow and having an approximately rectangular cross section in its entirety. The crus member 42 has a pair of right and left knee coupling plates 42*a*, 42*a* disposed to the base end side thereof and a knee plate 42*b* disposed to the front side thereof integrally with it. The knee coupling plates 42*a*, 42*a* couple the crus member 42 with the femoral member 41, and the knee plate 42*b* restricts that the crus member 42 is rotated forward of the femoral member 41. In contrast, the crus member 42 has a pair of right and left ankle coupling plates 42*c*, 42*c* at the extreme end thereof and an ankle plate 42*d* disposed on the back surface thereof integrally therewith. The ankle coupling plates 42*c*, 42*c* couple the crus member 42 with the foot member 43, and the ankle plate 42*d* restricts that the foot member 43 is rearward of the crus member 42. Note that the surfaces of the crus member 42 facing the knee plate 42*b* and the ankle plate 42*d* are opened, respectively. The cross section of the crus member 42 on the base end side is opened to a back surface side and formed in an approximately U-shape, and the back surface side opening accommodates the femoral member 41 when the crus member 42 is rotated backward of the femoral member 41. In contrast, the cross section of the crus member 42 on the extreme end side thereof is opened to the front side and formed in an approximately U-shape, and the foot member 43 projects from the front side opening of the crus member 42.

The knee member 44 covers and conceals the coupling portion, which corresponds to a knee joint, of the femoral member 41 and the crus member 42 from the front of the coupling portion to both the right and left sides thereof and is formed in an approximately U-shape. In contrast, the ankle cover member 45 covers and conceals the coupling portion, which corresponds to an ankle joint, of the crus member 42 and the foot member 43 from the front of the coupling portion to the tight and left sides thereof and is formed in an approximately U-shape likewise. Further, the foot member 43 is formed to be hollow with the extreme end thereof closed, and the outer periphery thereof, which corresponds to a sole, is formed to a surface that has such a degree of flatness as to permit the doll to stand thereon stably.

As shown in FIGS. 1 and 8, the base end portions of the femoral members 41, 41 are abutted against the right and left sides of the lower end of the waist member 12 and rotatably coupled with the waist member 12 by a third metal coupling 48 passing though both the abutting portions and the waist member 12. That is, the right and left femoral members 41, 41 and the abdomen member 12 are rotatably coupled with each other by causing the third metal coupling 48 to pass from the inner surface of one of the femoral member 41, 41 to the inner surface of the other femoral member 41 through the abdomen member 12 approximately in parallel with the first metal coupling 52.

Further, as shown in FIG. 8, the crus member 42 holds the extreme end of the femoral member 41 between the pair of knee coupling plates 42*a*, 42*a* formed at the base end portion thereof and rotatably coupled with the femoral member 41 by causing a fourth metal coupling 46 to pass through the femoral member 41 and the knee coupling plates 42*a*, 42*a*. At the time, the inner surfaces of both the ends of the knee member 44 are also abutted against the outer surfaces of both the knee coupling plates 42*a*, 42*a* of the crus member 42, and the fourth metal coupling 46 is caused to pass through both the ends of the abutted portions, thereby the knee member 44 is rotatably attached to the coupling portion of the femoral member 41 and the crus member 42.

Further, as shown in FIG. 8, the foot member 43 is held between the pair of ankle coupling plates 42*c*, 42*c* formed at the extreme end of the crus member 42 and rotatably coupled with the crus member 42 by causing a fifth metal coupling 47 to pass through the foot member 43 and the ankle coupling plates 42*c*, 42*c*. At the time, the inner surfaces of both the ends of the knee member 45 are also abutted against the outer surfaces of both the knee coupling plates 42*a*, 42*a* of the crus member 42, respectively, and the fifth metal coupling 47 is caused to pass through both the ends of the abutted portions, thereby the ankle cover member 45 is rotatably attached to the coupling portion of the crus member 42 and the foot member 43.

Figure 9:
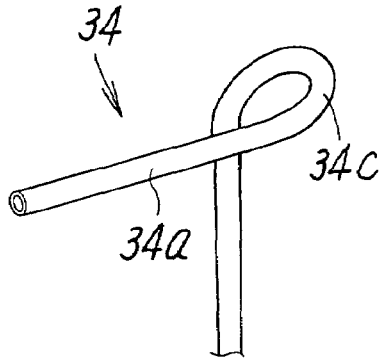
FIG. 9 is an explanatory view showing a first state of a method of forming an extraction prevention means in a metal coupling.
Figure 10:
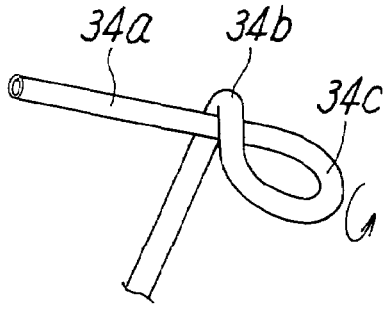
FIG. 10 is an explanatory view showing a second state of the method of forming the extraction prevention means in the metal coupling.
Figure 11:
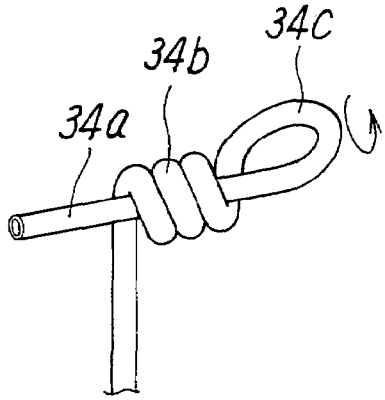
FIG. 11 is an explanatory view showing a third state of the method of forming the extraction prevention means in the metal coupling.

Incidentally, each of the first to fifth metal couplings 52, 34, 48, 46, and 47, the head portion metal coupling 25, the elbow metal coupling 35, and the wrist metal coupling 36 is composed of a metal wire whose surface is softened by vinyl coating. With this arrangement, since appropriate friction is applied between the respective metal couplings and the respective parts in the coupling portions, the doll can be held in any arbitrary attitude without obstructing the rotation of the respective parts in the coupling portions. All of the metal couplings other than the wrist metal coupling 36 are provided with an extraction prevention means disposed at both the ends thereof to prevent the metal couplings from being extracted from the respective coupling portions. To explain the extraction prevention means with reference to the second metal coupling 34 as an example, the extraction prevention means is formed to each end of the second metal coupling 34. Specifically, as shown in FIGS. 9 to 11, the extraction prevention means is composed of an extraction preventing bent portion 34*a*, a winding portion 34*b*, and an ear portion 34*c* formed to each end of the second metal coupling 34. The extraction preventing bent portion 34*a* is formed by bending an end of the metal wire in a direction perpendicular to the axial line of the second metal coupling 34, the winding portion 34*b* is formed by winding the end of the metal wire continuous to bent portion 34*a* of the second metal coupling 34 on the bent portion 34*a*, and the ear portion 34*c* is used to rotate the bent portion 34*a*. According to the method of forming the extraction prevention means, first, an end portion of the metal coupling 34 is bent, and the bent portion 34*a* and the ear portion 34*c* are formed such that the end portion is formed in an approximately T-shape in its entirety as shown in FIG. 9. Subsequently, as shown in FIGS. 10 and 11, the bent portion 34*a* is rotated by rotating the ear portion 34*c* with pincers or the like so that the number of winding of the winding portion 34*b* is increased until the metal coupling 34 is set to an appropriate length as a whole, thereby the second metal coupling 34 is provided with an extraction preventing function and the length thereof is adjusted at the same time.

Figure 12:
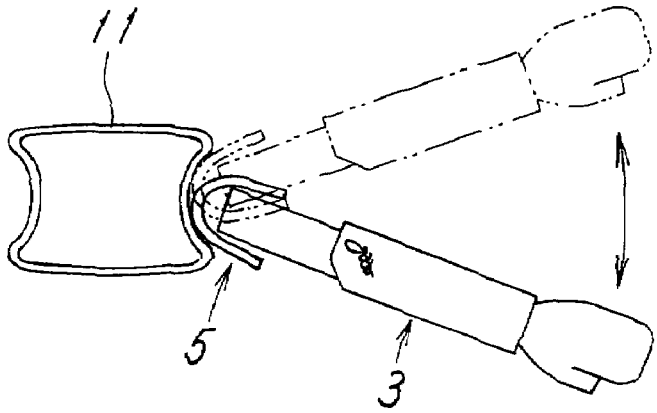
FIG. 12 is a plan view showing motion of the shoulder joint member and an arm, wherein parts other than the chest member, the shoulder joint member, and the left arm are omitted.
Figure 13:
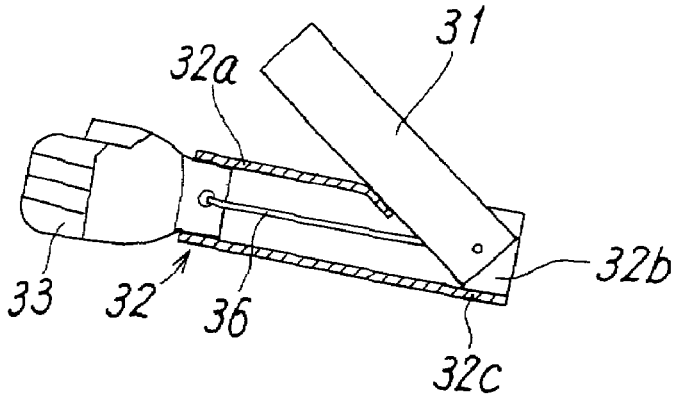
FIG. 13 is a main-portion enlarged sectional view showing motion of an arm.

In the paper doll arranged as described above, when the shoulder joint of the doll is moved as shown in, for example, FIG. 12, the approximately U-shaped shoulder joint member 5 and the hollow chest member 11 are deformed by being elastically flexed and crushed, respectively. Further, when the elbow joint of the doll is moved as shown in FIG. 13, the hollow portion 32*a* of the forearm member 32 is elastically crushed in the portion thereof abutted against the upper arm member 31, or the elbow coupling plate 32*b* is flexed. Furthermore, when the crotch joint of the doll is moved to a side of the trunk portion 1 as shown in FIG. 8, the base end portion of the hollow femoral member 41 is abutted against the waist member 12 and elastically crashed. As a result, the coupling portions of the shoulder joint, the elbow joint, and the crotch joint of the paper doll exhibit flexible motion nearer to that of the human shoulder joint, elbow joint, and crotch joint. As described above, since the respective portions of the doll, in particular, the respective parts of the doll coupled through the respective joint portions are deformed by the motion of the parts, the respective joint portions of the doll exhibit flexible motions nearer to that of the human joints. Accordingly, mechanical and stiff motion as that in the conventional dolls is reduced, which makes it possible to cause the paper doll to exhibit motion nearer to human motion.

Further, the coupling portions, which form the joints of the doll, are relatively simply arranged by causing the metal couplings to pass through the parts to be coupled, and moreover, the extraction of the metal couplings is prevented and the length thereof is adjusted simply and simultaneously. Therefore, a job for coupling parts with each other is simple, and, as a result, the doll can be made easily. Further, even if the respective parts are coupled firmly in the coupling portions or coupled therein loosely on the contrary while they are used, the degree of firmness of the coupling portions can be easily adjusted by increasing or decreasing the number of winding of the winding portions by rotating the ear portions of the extraction prevention means, and further the respective parts can be easily repaired and replaced.

Although the embodiment described above is provided with the shoulder members 51, the knee members 44, and the ankle cover members 45, it is not always necessary to provide them, and further even if they are provided, they need not necessarily have the shapes and the sizes shown in the embodiment, and any arbitrary shapes and sizes may be employed in the ranges in which the motion of the respective coupling portions are not obstructed. Further, the shape of the face member 24, the picture of the face, the shape of the wrist member, the pattern of the outer surface of the doll, and the like may be arbitrarily selected.

Further, in the above embodiment, the extraction prevention means each including all of the bent portion, the winding portion, and the ear portion are disposed to both the ends of the respective metal couplings other than the wrist metal coupling 36. However, an extraction prevention means composed of only a bent portion may be disposed to ones of the ends of the metal couplings, an extraction prevention means composed of the bent portion, the winding portion, and the ear portion may be disposed to the other ends thereof, and the length of the metal couplings may be adjusted at the other ends.

The invention claimed is:

1. A paper doll, comprising:

a plurality of parts formed of a folded paper sheet and coupled with each other, wherein:

the plurality of parts includes a trunk portion, a head portion, right and left arms, right and left legs, and right and left shoulder joint members to attach the arms to the trunk portion;

the trunk portion is formed to be hollow and disposed with an axial line of the trunk portion directed in a longitudinal direction and has recesses formed on right and left sides of the trunk portion that extend in an axial direction;

each of the right and left shoulder joint members is formed in an approximately U-shape and includes an intermediate wall portion engaged in each one of the recesses of the trunk portion and a pair of side wall portions continuous to the intermediate wall portion and opening outward, and the intermediate wall portion extends along with the recess in a state that the intermediate wall is abutted against a bottom portion of the recess, and the shoulder joint members are rotatably coupled with the trunk portion through the intermediate wall portions;

each of the arms includes an upper arm member, a forearm member and a wrist member movably coupled with each other, at least the upper arm member is formed to be hollow, a base end portion of the upper arm member is held between the pair of side wall portions of the shoulder joint member, and the side wall portions are rotatably coupled with the upper arm member; and each of the legs includes a femoral member, a crus member, and a foot member movably coupled each other, at least the femoral member is formed to be hollow, and the femoral member is abutted against a side of the trunk portion and rotatably coupled with the trunk portion.

2. A paper doll according to claim 1, wherein the trunk portion is formed of a hollow chest member having a largest section size, a hollow abdomen member having an intermediate section size and a hollow waist member having a smallest section size, these members being coupled with each other, the chest member has the recesses formed thereon, the shoulder joint members are coupled with the chest member at positions of the recesses, and the legs are coupled with the waist member.

3. A paper doll according to claim 1, further comprising:

metal couplings to movably couple the plurality of flexible parts formed of the folded paper sheet, wherein:

the right and left shoulder joint members are rotatably coupled with the trunk portion by a first one of the metal couplings passing through the trunk portion and the intermediate wall portions of the shoulder joint members;

the base end portions of the upper arm members are rotatably coupled with shoulder joint members by a second one of the metal couplings passing through the pair of side wall portions of the shoulder joint members and the upper arm members; and the femoral members are coupled with the trunk portion by a third one of the metal couplings passing through the trunk portion.

4. A paper doll according to claim 3, wherein the arms further include shoulder members to cover coupling portions of the shoulder joint members and the upper arm members, and the shoulder members are bent in a U-shape and rotatably attached to the shoulder joint members by the second one of the metal couplings.

5. A paper doll according to claim 3, wherein each of the legs further includes an approximately U-shaped knee member to cover the coupling portion of the femoral member and the crus member and an approximately U-shaped ankle cover member to cover a coupling portion of the femoral member and the foot member, the knee member is rotatably coupled with a coupling portion of the femoral member and the crus member by a fourth one of the metal couplings to couple both the members, and the ankle cover member is rotatably coupled with the coupling portion of both the members by a fifth one of the metal couplings to couple the crus member with the foot member.

6. A paper doll according to claim 3, wherein each of the metal couplings is formed of a metal wire having a softened surface, has extraction preventing bent portions, which are formed by bending ends of the wire in a direction perpendicular to the axial direction, at both the ends thereof and has a winding portion, which is formed by winding the end of the metal coupling on the bent portion, and an ear portion to rotate at least one end of the bent portion, and a length of the metal coupling can be adjusted by increasing a number of windings of the winding portion.

7. A paper doll according to claim 6, wherein the surface of each of the metal couplings is softened by vinyl coating.

8. A paper doll according to claim 4, wherein each of the metal couplings is formed of a metal wire having a softened surface, has extraction preventing bent portions, which are formed by bending ends of the wire in a direction perpendicular to the axial direction, at both the ends thereof and has a winding portion, which is formed by winding the end of the metal coupling on the bent portion, and an ear portion to rotate at least one end of the bent portion, and a length of the metal coupling can be adjusted by increasing number of windings of the winding portion.

9. A paper doll according to claim 5, wherein each of the metal couplings is formed of a metal wire having a softened surface, has extraction preventing bent portions, which are formed by bending ends of the wire in a direction perpendicular to the axial direction, at both the ends thereof and has a winding portion, which is formed by winding the end of the metal coupling on the bent portion, and an ear portion to rotate at least one end of the bent portion, and a length of the metal coupling can be adjusted by increasing a number of windings of the winding portion.

10. A paper doll according to claim 8, wherein the surface of each of the metal couplings is softened by vinyl coating.

11. A paper doll according to claim 9, wherein the surface of each of the metal couplings is softened by vinyl coating.

12. A paper doll according to claim 1, wherein when one of the arms is moved, one of the trunk member or the intermediate wall portion engaged in the recess of the trunk portion is elastically flexed, and an other of the trunk member or the intermediate wall portion engaged in the recess of the trunk portion is elastically crushed.

* * * * *